United States Patent [19]

Nichol

[11] Patent Number: 4,850,273

[45] Date of Patent: Jul. 25, 1989

[54] HAND OR PRODUCTION PRINTER OR THE LIKE

[75] Inventor: Barry J. Nichol, Doncaster, Australia

[73] Assignee: Nichol International Pty. Ltd., Australia

[21] Appl. No.: 926,942

[22] Filed: Oct. 30, 1986

[30] Foreign Application Priority Data

Oct. 31, 1985 [AU] Australia ..... PH03201/85
Oct. 31, 1985 [AU] Australia ..... PH03202/85

[51] Int. Cl.[4] ..... B41F 17/00; B41J 27/00

[52] U.S. Cl. ..... 101/36; 101/105; 101/329; 101/375

[58] Field of Search ..... 101/327, 328, 329, 375, 101/376, 103, 105, 35, 36, 37

[56] References Cited

U.S. PATENT DOCUMENTS

| | | | |
|---|---|---|---|
| 2,746,380 | 5/1956 | Gottscho | 101/35 |
| 3,092,019 | 6/1963 | Buskirk | 101/35 |
| 3,208,375 | 9/1965 | Worth | 101/35 |
| 3,220,341 | 11/1965 | Price, Jr. | 101/35 |
| 3,327,624 | 6/1967 | Beaver | 101/35 |
| 3,624,730 | 11/1971 | Gottscho | 101/35 |
| 3,808,970 | 5/1979 | Delligatti | 101/35 |
| 3,828,665 | 8/1974 | Ogura et al. | 101/36 |
| 4,000,690 | 1/1977 | Geurtsen et al. | 101/36 |
| 4,049,677 | 8/1977 | Hamisch, Jr. | 101/103 X |
| 4,116,126 | 9/1978 | Milner | 101/376 X |
| 4,152,980 | 5/1979 | Siegal | 101/329 X |
| 4,270,454 | 6/1981 | Gill et al. | 101/35 X |
| 4,387,645 | 6/1983 | Holland-Letz et al. | 101/327 |
| 4,397,233 | 8/1983 | Mori | 101/35 |
| 4,470,712 | 9/1984 | Lohr | 101/103 X |
| 4,566,382 | 1/1986 | Bronson et al. | 101/35 |
| 4,566,386 | 1/1986 | Davison | 101/327 X |

*Primary Examiner*—Edgar S. Burr
*Assistant Examiner*—James R. McDaniel
*Attorney, Agent, or Firm*—Lowe, Price, LeBlanc, Becker & Shur

[57] ABSTRACT

A printer is disclosed for marking packages or objects having a printing drum, which is carried by a return mechanism, with an ink supply for applying ink to the printing drum. The return mechanism includes a base plate which is rotatable about a central axis and an eccentric member which is constrained to move in a circular path on rotation of the base plate. A spring acts on the eccentric member so as to bias the member to a predetermined position in order to bias the base plate and the printing drum to a corresponding initial position.

14 Claims, 9 Drawing Sheets

58
66
68
70
72
74
76
78
80
64
60
7

HAND OR PRODUCTION PRINTER OR THE LIKE

This invention relates to a printer for marking packages or objects.

More particularly, the invention relates to a printer which can be used for printing on the surface of containers such as cardboard cartons travelling along a conveyor. Frequently printers of this type include a printing drum which is rotatably mounted and located so that it is contacted by the containers and is rotated about its axis as the containers pass. The printing drum includes letters, numbers or symbols which are printed onto the surface of a container. In many applications, it is important that the material to be printed on the containers is located at a known part of the container. The printing drum therefore needs to be correctly returned to an initial position after each printing operation.

The general object of the present invention is to provide a printer for marking packages or objects, the printer having a simple but effective return mechanism for returning the printing drum to an initial position.

According to the present invention, there is provided a printer for marking packages or objects, the printer including a printing drum which is carried by a return mechanism, ink supply means for applying ink to the printing drum and a return mechanism including a first portion which, in use, is rotatable about a first axis, and eccentric member which is constrained to move in a circular path on rotation of the first member and spring means acting on the eccentric member so as to bias it to a predetermined position whereby the first portion and the printing drum are biased to a corresponding initial position.

The invention will now be more fully described with reference to the accompanying drawings, in which.

Figure 1:
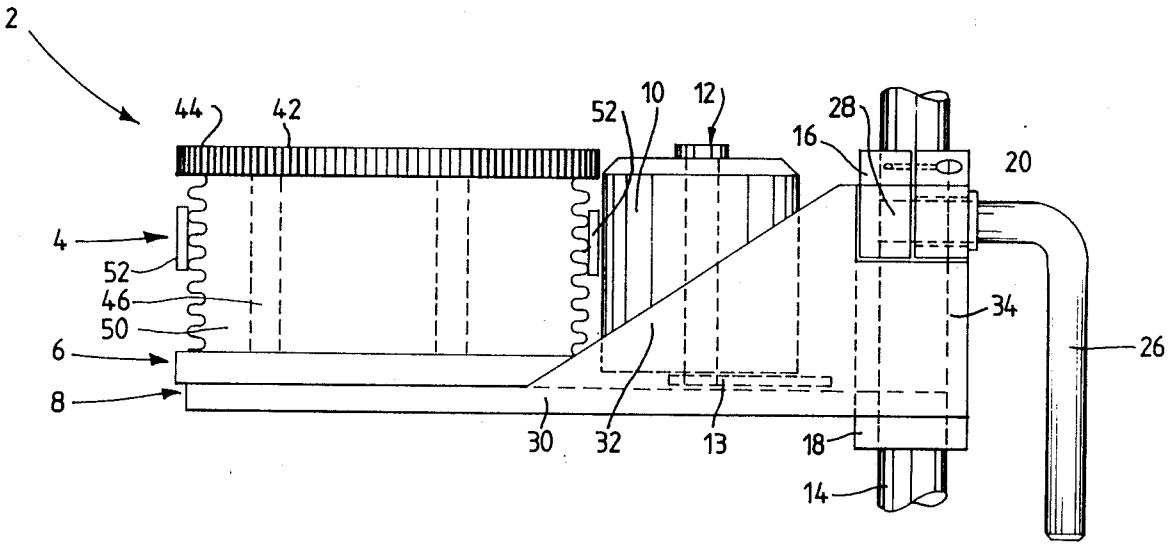
FIG. 1 is a side view of a printer constructed in accordance with the invention.
Figure 2:
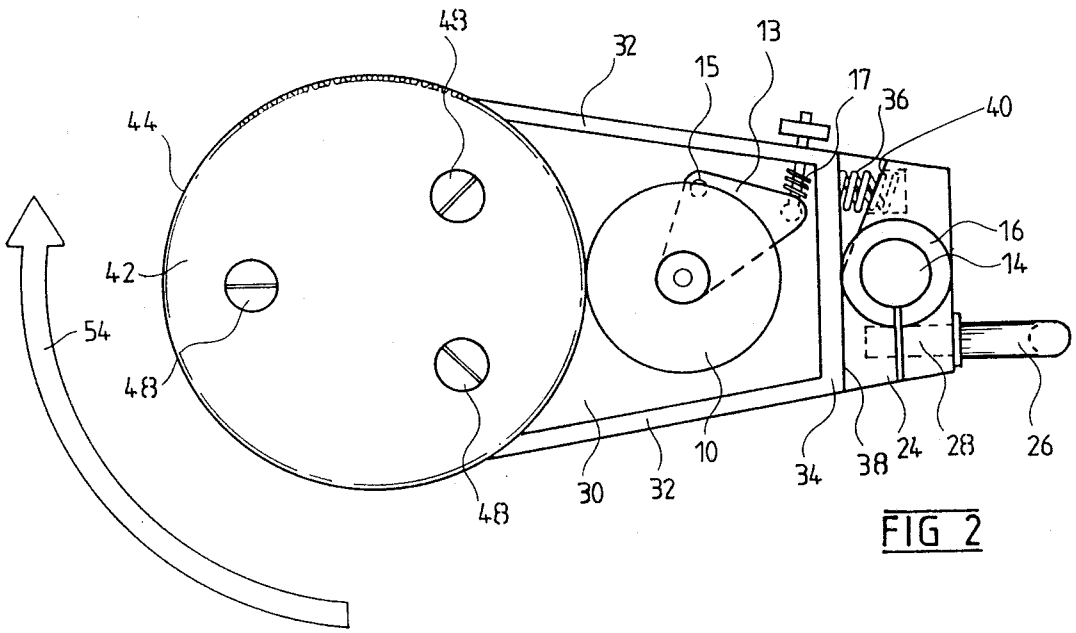
FIG. 2 is a plan view.
Figure 3:
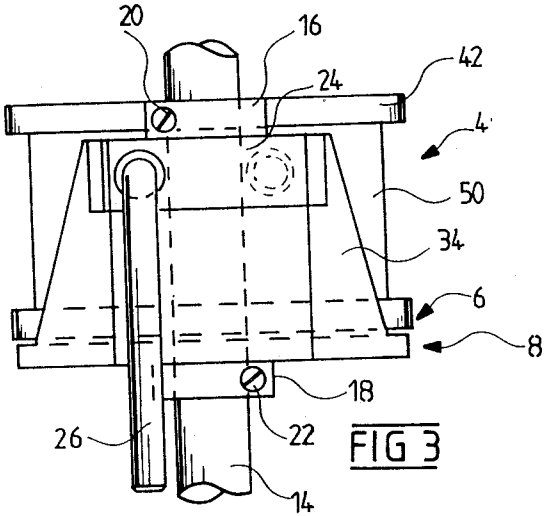
FIG. 3 is an end view.

The printer 2 shown in FIGS. 1 to 3 comprises a printing drum 4 which is mounted on a return mechanism 6 which in turn is mounted upon a support bracket 8. The printer includes an inking roller 10 mounted for rotation on a shaft 12 which projects upwardly from a mounting plate 13 which is pivoted to the support bracket 8 at 15. A spring 17 is provided to bias the roller towards the drum 4. The support bracket is mounted on an upstanding shaft 14, the shaft being located in use adjacent to a conveyor line, the arrangement being such that the containers (not shown) engage the printing drum 4 and have material printed thereon. The bracket 8 is mounted on the shaft between upper and lower collars 16 and 18. The collars 16 and 18 include locking screws 20 and 22 which can be used to alter the position of the collars and hence adjust the height of the bracket. The radial position of the printing drum 4 relative to the shaft 14 can be set by adjusting the position of a bifurcated mounting block 24. The two arms of the bifurcated block can be tightened by means of a locking bolt 26, one end 28 of which is threadably received in the mounting block 24.

The bracket 8 has a base plate 30 with inclined sidewalls 32 and rear wall 34. It is preferred that the roller 10 is located in a shallow recess (not shown) in the bracket 15 so as to collect ink which inadvertently flows from the roller 10. A compression spring 36 acts between the rear wall 34 and the mounting block 24 and biases the bracket 8 in an anti-clockwise direction, as seen in FIG. 2. The block 24 is limited in rotation in the anti-clockwise direction by the rear wall 34 engaging the front face 38 of the block 24. Clockwise rotation is limited by the rear wall 34 engaging an inclined face 40 of the block.

The printing drum 4 includes a circular top plate 42 having a knurled edge surface 44. The drum includes internal spacers 46 which extend upwardly from the return mechanism 6 and are held in place by screws 48. The drum includes a corrugated cylindrical support surface 50 upon which rubber printing blocks 52 can be selectively mounted. The arrangement is such that the fluted edge 44 will be contacted by a carton (not shown) moving in the direction of arrow 54 that will cause rotation of the drum in a clockwise direction. This causes the printing blocks 52 to print onto the containers as they pass there against and during rotation the printing blocks 52 will engage the face of the inking roller 10 and will have ink applied thereto in readiness for the next printing operation.

Alternatively if the containers travel in a direction opposite to that shown by the arrow 54, the configuration of the block 24 will be such that the faces 38 and 40 are interchanged. Clockwise rotation will be limited by the wall 34 engaging a front face of the block 24, similar to face 38 and anti-clockwise rotation will be limited by the wall 34 engaging an inclined face of the block 24, similar to face 40.

In order to ensure that the material printed by the printing blocks 52 always occurs at the same relative position on the containers, it is necessary that the return mechanism 6 operates to rotate the drum 54 to a selected initial position after the drum has disengaged the container. This ensures that the next container which arrives will have the printed material printed at the correct location thereon.

Figure 5:
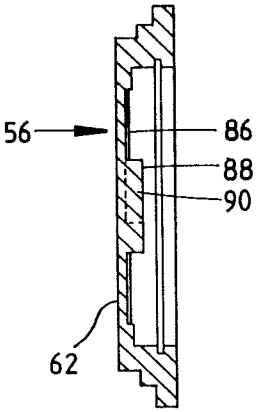
FIG. 5 is a sectional view along the line 5—5 of FIG. 4.
Figure 4:
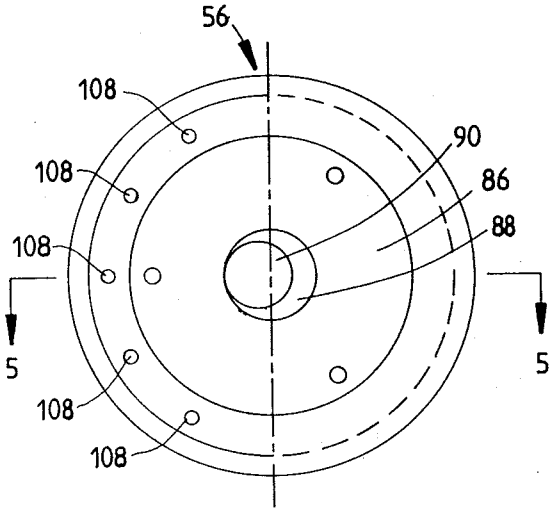
FIG. 4 is a plan view of a base plate for the return mechanism.
Figures 6, 7, 8, 9, 10:
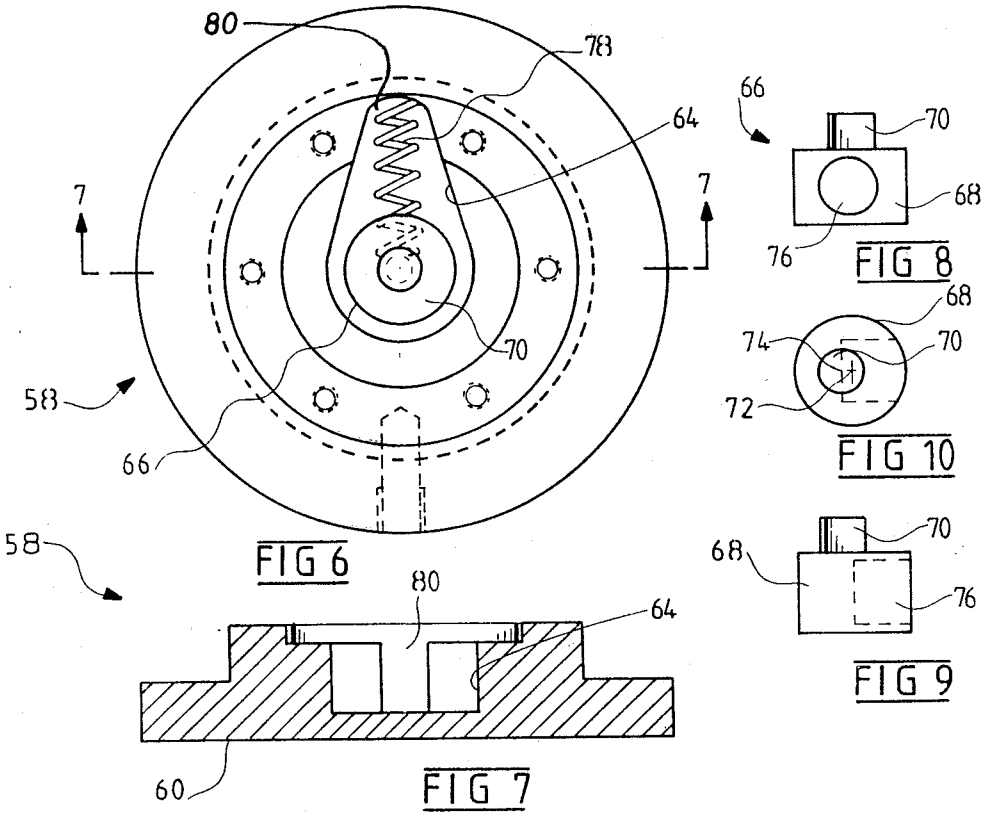
FIG. 6 is an inverted plan view of a hub.
FIG. 7 is a sectional view along the lines 7—7 of FIG. 6.
FIG. 8 is an end view of an eccentric member.
FIG. 9 is a side view of the eccentric member.
FIG. 10 is a plan view of the eccentric member.

The return mechanism 6 includes a base plate 56 which is shown in FIGS. 4 and 5. It also includes a hub 58 which is shown in FIGS. 6 and 7. The hub has a bottom surface 60 which is connected to the support bracket 8. The top face 62 of the base plate 56 serves as the lower support for the spacer elements 46 of the drum. As best seen in FIGS. 6 and 7, the hub includes a generally radially extending tapered recess 64 within which is located an eccentric member 66. The eccentric member 66 comprises a cylindrical body 68 and a bearing shaft 70 projecting therefrom. The axis 72 and 74 of the body 68 and shaft 70 are offset as seen in FIG. 10. The body 68 includes a recess 76 which in use receives one end of a compression spring 78. The other end of th spring 78 bears against a circumferential face 80 of the recess 64 as best seen in FIG. 6.

Figure 11:
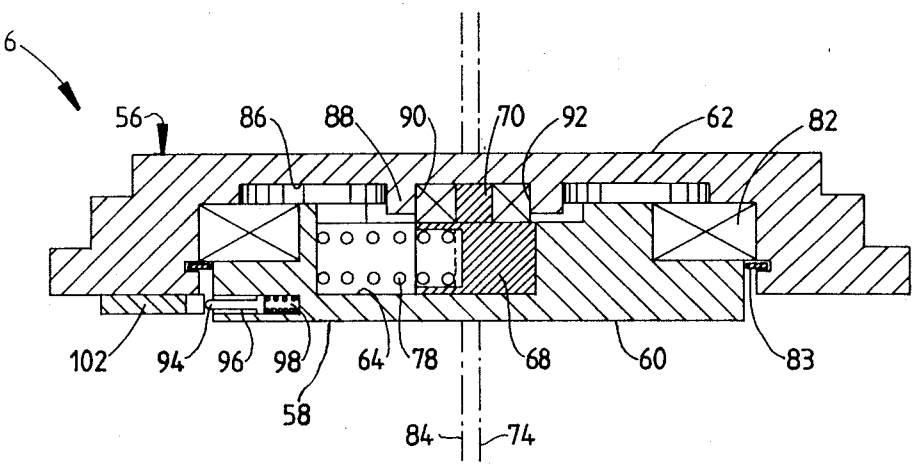
FIG. 11 is a cross section through the assembled return mechanism.

FIG. 11 shows in cross section the assembled return mechanism. The hub 58 and base plate 56 are press fit together against a ballbearing race 82 whereby the bas plate 56 is rotatable relative to the hub 58 about an axis 84 (which is the axis of rotation of the printing drum 4 relative to the support bracket 8). A circlip 83 is located in a slot formed in the base plate 56 so as to prevent inadvertent separation of the plate 56 from the race 82. The underside surface 86 of the plate 56 is provided with a projecting boss 88 which in turn is formed with a recess 90. The recess 90 is eccentrically located with respect to the boss and the axis 84. The recess 90 has press fit therein a ballbearing race 92. The inner periphery of the race 92 receives the shaft 70 of the eccentric member 66 so that the eccentric member 66 is rotatable to the plate 58. Because, however, of the eccentricity of the recess 90, the cylindrical body 68 of the eccentric members 66 will move in a circular path in the recess 64. This causes compression and expansion of the spring 78. The arrangement is such that the tendency of the spring will be towards its expanded condition whereupon rotation of the plate 56 relative to the hub 58 will occur until the expanded position of the spring 78 is reached. This course defines a unique normal position of the plate 56 relative to the hub 58. This represents the initial position of the printing drum to which it will always return under the influence of the eccentric and the spring 78. It has been found that the arrangement is simple to construct, reliable and very robust in its operation.

Figure 12:
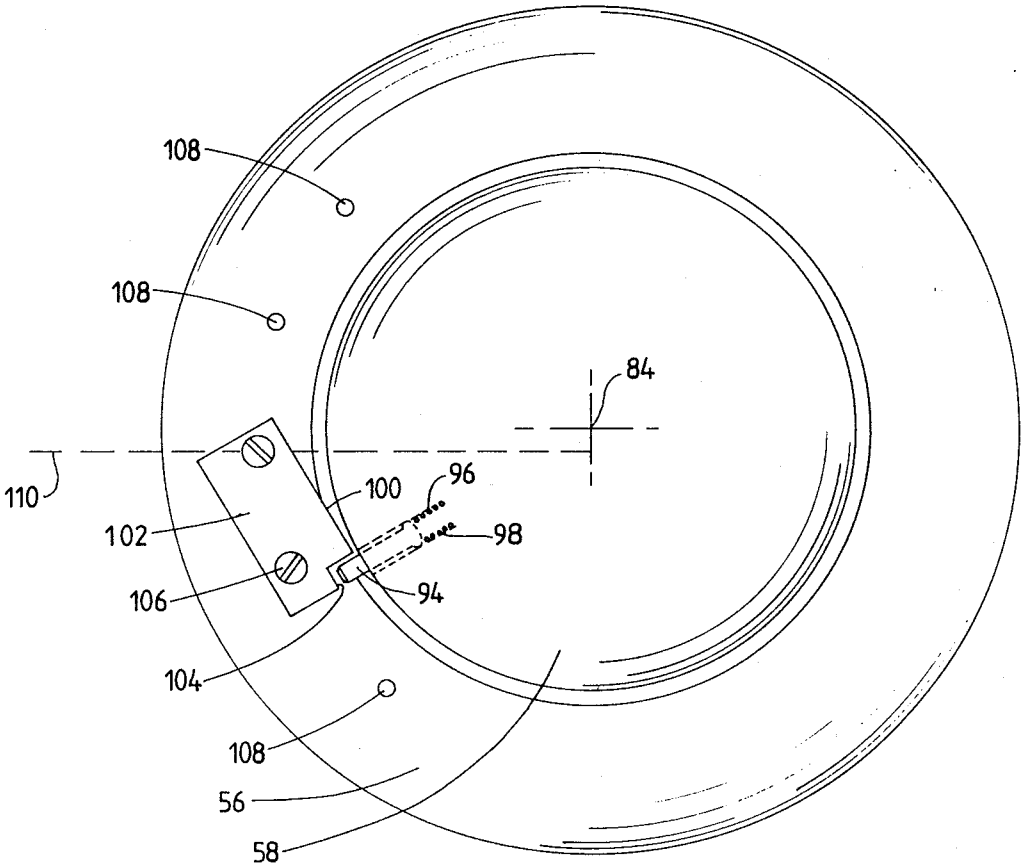
FIG. 12 is an underside view of the return mechanism.

The return mechanism 6 may include a ratchet arrangement to prevent reverse rotation of the plate 56 relative to the hub which might occur where the containers move past the printing drum at relatively high velocity. One simple arrangement is illustrated in FIGS. 11 and 12. In this arrangement, a pin 94 is mounted for sliding movement in a recess 96, the pin being biased in a radially outward direction by means of a compression spring 98. The projecting end of the pin 94 will come into contact with a projecting edge 100 of a ratchet plate 102. The plate 102 includes a rebate 104, the arrangement is such that the pin is radially retracted against the spring 98, by the edge 100 as it passes therealong. At the end of the edge 100, the pin 94 moves outwardly into the rebate 104 thus preventing rotation in a clockwise direction, as seen in FIG. 12. The plate 102 is connected to the plate 56 by means of screws 106 which are received in threaded holes 108. In this arrangement, the line 110 marks the position to which the plate 56 will be returned by the action of the spring and eccentric. Selection of holes above the line (as seen in FIG. 12) is appropriate for slow moving cartons whereas selection of the mounting holes below the line is appropriate for fast moving packs.

Figure 13:
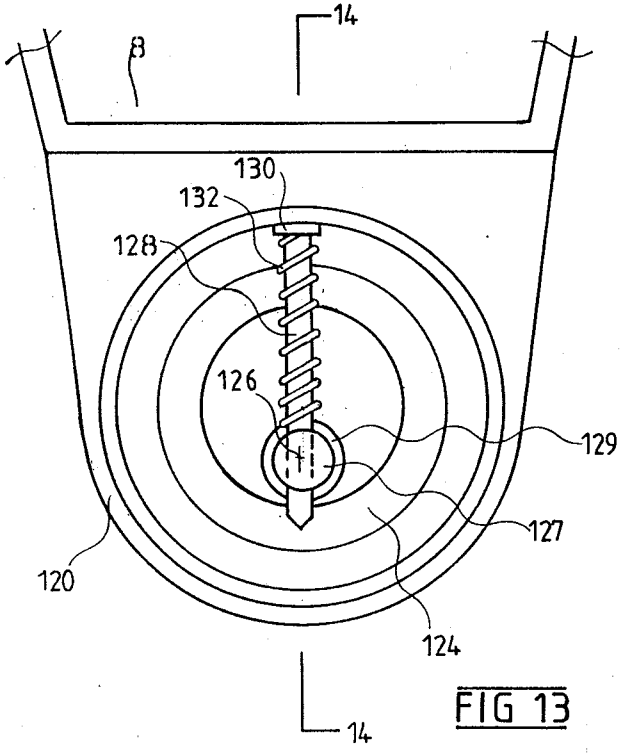
FIG. 13 is a schematic plan view of an alternative embodiment of the invention.
Figure 14:
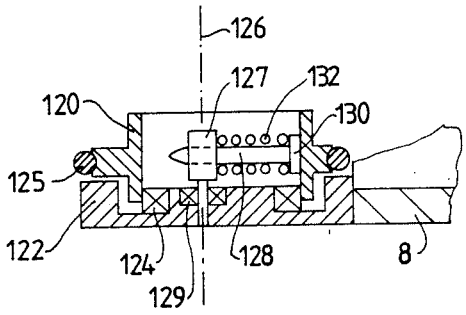
FIG. 14 is a section along the line 14—14 of FIG. 13.

FIGS. 13 and 14 illustrate a modified arrangement. In this arrangement, which is more suited for small applications, a generally cylindrical body 120 is rotatably mounted relative to a hub plate 122 by a bearing race 124. An O-ring 125 is mounted on the body 120 and in use will be engaged by a carton or other surface to be printed. The body 120 carries a printing drum (not shown) of analogous construction to that shown in FIGS. 1 to 3. The hub 122 has projecting therefrom a rotatable shaft 127 which is rotatably mounted relative to the hub plate 122 by a bearing race 129. The shaft 127 is rotatable about an axis 126 which is offset relative to the axis of the body 120. The shaft 127 includes an opening through which passes a pin 128 having a head 130. A compression spring 132 is mounted on the pin and acts between the head of the pin and the shaft 124. The arrangement is such that the eccentric mounting of the shaft 124 and the action of the spring 132 will always cause the body 120 to be rotated to a unique rest position relative to the hub 122 corresponding to the position in which the spring 132 is in its expanded position. Thus, it can be used to initialize the position of a printing drum as described in the other embodiments.

Figure 15:
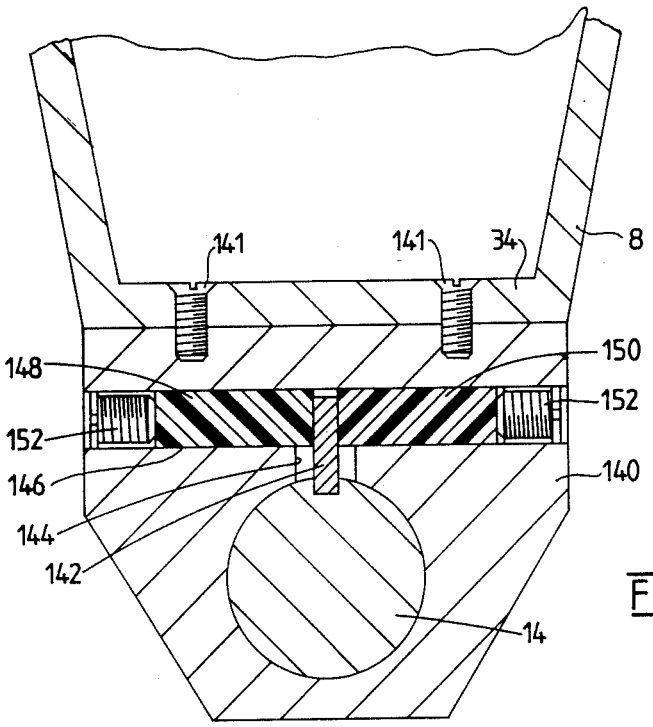
FIG. 15 is a fragmentary sectional view through a modified embodiment of the invention.

FIG. 15 shows a modified arrangement for resiliently mounting the bracket 8 relative to the shaft 14. In this arrangement, the rear wall 34 of the bracket 8 is fixedly connected to a mounting block 140 by screws 141. The mounting block 140 is fixed in axial position on the shaft 14 by use of the collars 16 and 18 as described previously. Rotation of the body 140 about the shaft 14 is however resiliently restrained by means of a key 142 which projects from a shaft 14 through an opening 144 to a bore 146. Resilient cylindrical blocks 148 and 150 are located in the bore 146 and are pressed into snug engagement with opposite sides of the key 142 by grub screws 152. The arrangement is such that rotation of the body 140 is resiliently restrained by compression and expansion of the bodies 148 and 150 under the influence of movement of the key 142. The bodies 148 and 150 may be formed by polyurothene.

Many modifications will be apparent to those skilled in the art without departing from the spirit and scope of the invention.

I claim:

1. A printer for marking packages or objects, comprising a printing drum; a return mechanism carrying the printing drum and supply means for applying ink to the printing drum, said return mechanism including first and second portions and a bearing between said portions to permit the first portion to rotate relative to the second portion about a first axis, an eccentric member which is constrained to move in a circular path on rotation of the first portion about a second axis which is off-set relative to the first axis, said return mechanism further including a compression spring means one end of which bears against said eccentric member and the other end of which compression spring means acts against the second portion, the action of the compression spring means acting on the eccentric member to bias it to a predetermined position whereby the first portion and the printing drum are biased to a corresponding initial position.

2. A printer as claimed in claim 1 wherein the second portion includes a body having a recess in which a part of the eccentric member and said compression spring means are located.

3. A printer as claimed in claim 2 wherein the eccentric member comprises a body and a shaft portion and wherein the shaft portion is coupled to the first portion by means of a second bearing member.

4. A printer as claimed in claim 3 wherein said one end of the compression spring means is received within a recess in the body of the eccentric member.

5. A printer as claimed in claim 1 wherein the return mechanism includes a ratchet to enable relative rotation of the first and second portions in only one direction.

6. A printer as claimed in claim 5 wherein the ratchet means includes a pin resiliently projecting from the second portion and engageable with a cam face which is inclined relative to the path of movement of the pin so as to retract the pin into the second member, the cam face including a rebate which permits retraction of the pin and therefore prevents rotation in the reverse direction.

7. A printer as claimed in claim 1 wherein the return mechanism is mounted on a bracket which is mounted for limited rotation on an upright mounting shaft.

8. A printer as claimed in claim 7 wherein the bracket is mounted for rotation on the mounting shaft and is adjustable in axial position by means of collars which are fixed to the shaft and wherein a bifurcated mounting block can be fixed to the mounting shaft, a spring being provided so as to act between the mounting body and the support bracket so as to resiliently mount the support bracket relative to the shaft.

9. A printer as claimed in claim 7 wherein the support bracket is fixedly connected to a mounting body which is rotatable on the shaft but is adjustably fixed in axial position thereon.

10. A printer as claimed in claim 9 wherein the shaft includes a key which extends into an opening in the mounting body, there being provided resilient blocks which engage opposite sides of the key so as to resiliently restrain rotation of the mounting body relative to the shaft.

11. A printer as claimed in claim 1 wherein the eccentric member comprises a rotatable shaft projecting from the second portion, said shaft including a transverse opening which receives a headed pin, and wherein a compression spring is mounted on the pin and acts between the head thereof and the shaft whereby the head of the pin is biased into engagement with the first portion, the arrangement being such that expansion of said compression spring corresponds with said initial position.

12. A printer as claimed in claim 1 wherein the first portion comprises a first body having a recess in a lower face thereof and wherein said second portion comprises a second body which is located within the recess of the first portion.

13. A printer as claimed in claim 12 wherein said bearing is annular and the eccentric member and compression spring means are located generally with the annular bearing.

14. A printer for marking packages or objects, comprising a printing drum which is carried by a return mechanism, and supply means for applying ink to the printing drum, said return mechanism including first and second portions and a bearing between the portions to permit the first portion to rotate about a first axis, an eccentric member which is mounted in the second portion for rotation about a second axis which is off-set relative to the first axis, said return mechanism further including a shaft projecting inwardly from the first portion and passing through a bore in the eccentric member, a compression spring mounted over the shaft, one end of the compression spring bearing against said eccentric member and the other end of the compression spring acting against the first portion, the action of the compression spring acting on the eccentric member being operable to bias it to a predetermined position whereby the first portion and the printing drum are biased to a corresponding initial position.

* * * * *